US009211715B2

(12) United States Patent
Ibe et al.

(10) Patent No.: US 9,211,715 B2
(45) Date of Patent: Dec. 15, 2015

(54) LIQUID EJECTION HEAD AND PROCESS FOR PRODUCING LIQUID EJECTION HEAD

(71) Applicant: CANON KABUSHIKI KAISHA, Tokyo (JP)

(72) Inventors: Satoshi Ibe, Yokohama (JP); Shingo Nagata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/479,544

(22) Filed: Sep. 8, 2014

(65) Prior Publication Data

US 2015/0109368 A1 Apr. 23, 2015

(30) Foreign Application Priority Data

Oct. 23, 2013 (JP) ..... 2013-220307

(51) Int. Cl.
*B41J 2/14* (2006.01)
*B41J 2/16* (2006.01)

(52) U.S. Cl.
CPC ..... *B41J 2/1603* (2013.01); *B41J 2/1623* (2013.01); *B41J 2/1628* (2013.01); *B41J 2/1629* (2013.01); *B41J 2/1631* (2013.01); *B41J 2/1632* (2013.01); *B41J 2/1639* (2013.01); *B41J 2/1433* (2013.01)

(58) Field of Classification Search
CPC ..... B41J 2/1623; B41J 2002/14491; B41J 2/1632; B41J 2/1433; B41J 2002/14306; B41J 2002/14362; B41J 2/14145; B41J 2/14024; B41J 2/14072; B41J 2/1635
USPC ..... 347/40, 44, 64–65, 71
See application file for complete search history.

(56) References Cited

U.S. PATENT DOCUMENTS

| | | | | |
|---|---|---|---|---|
| 6,585,357 | B1 * | 7/2003 | Nishimura | 347/68 |
| 7,287,847 | B2 | 10/2007 | Fujii et al. | |
| 7,591,071 | B2 | 9/2009 | Ibe et al. | |
| 7,641,316 | B2 | 1/2010 | Sakai et al. | |
| 7,681,993 | B2 | 3/2010 | Ono et al. | |
| 7,857,429 | B2 | 12/2010 | Ozaki et al. | |
| 7,862,158 | B2 | 1/2011 | Fujii et al. | |
| 8,075,107 | B2 | 12/2011 | Hatsui et al. | |
| 8,079,675 | B2 | 12/2011 | Ozaki et al. | |
| 8,091,234 | B2 | 1/2012 | Ibe et al. | |
| 8,152,279 | B2 | 4/2012 | Sakuma et al. | |
| 8,267,503 | B2 | 9/2012 | Koyama et al. | |
| 8,291,576 | B2 | 10/2012 | Ibe et al. | |
| 8,613,862 | B2 | 12/2013 | Asai et al. | |
| 8,636,336 | B2 | 1/2014 | Goto | |

FOREIGN PATENT DOCUMENTS

JP 2012-187804 A 10/2012

* cited by examiner

*Primary Examiner* — Thinh Nguyen
(74) *Attorney, Agent, or Firm* — Fitzpatrick, Cella, Harper & Scinto

(57) ABSTRACT

A liquid ejection head including a recording element substrate provided with a substrate and a flow-path-forming member forming a flow path in a principal surface of the substrate, a support member supporting the recording element substrate and an underfill material covering at least a joint portion at which the substrate and the support member are joined to each other, wherein the flow-path-forming member is formed in such a manner that an end portion thereof projects from at least one side surface of the substrate, the underfill material covers an external surface of the joint portion and covers the at least one side surface of the substrate in such a manner that the underfill material reaches the projecting end portion of the flow-path-forming member.

11 Claims, 7 Drawing Sheets

LIQUID EJECTION HEAD AND PROCESS FOR PRODUCING LIQUID EJECTION HEAD

BACKGROUND OF THE INVENTION

1. Field of the Invention

The present invention relates to a liquid ejection head from which a liquid is ejected and a process for producing the liquid ejection head.

2. Description of the Related Art

As an example of a liquid ejection head, an ink jet recording head ejecting a liquid such as an ink for use in recording is known. A general ink jet recording head has a recording element substrate in which a flow-path-forming member capable of ejecting an ink droplet from a liquid ejection orifice by an energy-generating element for applying ejection energy to a liquid is joined to a principal plane of the substrate, and an electric wiring board for applying an electric signal to the recording element substrate.

On the substrate surface to which the flow-path-forming member is joined, an electrothermal converter of a heating resistor is provided as the energy-generating element. An ink is heated by the electrothermal converter within the flow-path-forming member and ejected as an ink droplet from the liquid ejection orifice by the action of film boiling. A system in which an ink droplet is ejected by using an electricity-pressure converter such as a piezoelectric element in place of the electrothermal converter is also known.

The surface on the side opposite to the flow-path-forming member of such a substrate is joined to an ink tank, and an ink supply path through which an ink within the ink tank is supplied to a flow path of the flow-path-forming member passes through the substrate from this surface.

With respect to such a conventional ink jet recording head, Japanese Patent Application Laid-Open No. 2012-187804 discloses a method capable of reducing a possibility that a recording element substrate may be broken by a temperature or humidity cycle and a possibility that an ink may leak from a boundary surface between an ink tank and a recording element substrate which are joined to each other.

According to the recording head described in Japanese Patent Application Laid-Open No. 2012-187804, a depressed portion in which the recording element substrate is housed with a plane on which a liquid ejection orifice is formed (referred to as an ejection orifice face) facing to the outside is formed in the ink tank to which the recording element substrate is joined. A bottom surface of the depressed portion has an ink supply port communicating with an opening of an ink supply path exposed to a back surface of the recording element substrate and a principal plane which is present around the ink supply port and is joined to the back surface of the recording element substrate with an adhesive. An electric connection portion connecting an electric wiring board is provided at an end portion of the ejection orifice face.

The recording element substrate is provided with a plurality of side surfaces including a side surface of a non-electric connection side formed on a side on which the electric connection portion of the ejection orifice face is not provided and a side surface of an electric connection side formed on a side on which the electric connection portion of the ejection orifice face is provided.

This recording element substrate is joined to the ink tank at the principal plane located at the bottom surface of the depressed portion through an adhesive. A sealing material is filled into a space between the side surface of the electric connection side and a side wall of the depressed portion, and the electric connection portion is also sealed with the sealing material. On the other hand, between the side surface of the non-electric connection side and a side wall of the depressed portion, the sealing material only covers an external surface of an adhesive exposed from between the back surface of the recording element substrate and the bottom surface of the depressed portion over the whole length thereof, and most of the side surface of the non-electric connection side is exposed without being covered with the sealing material.

According to such a method, the sealing material is filled into only a partial space corresponding to the side surface of the electric connection side of the recording element substrate without filling all the spaces between the respective side surfaces of the recording element substrate and the side walls of the depressed portion with the sealing material. Therefore, it is expected that the breakage of the recording element substrate by the temperature or humidity cycle is hard to occur.

SUMMARY OF THE INVENTION

In an aspect of the present invention, there is provided a liquid ejection head comprising a recording element substrate provided with a substrate and a flow-path-forming member forming a flow path in a principal surface of the substrate, a support member supporting the recording element substrate and an underfill material covering at least a joint portion at which the substrate and the support member are joined to each other.

In this liquid ejection head, the flow-path-forming member is formed in such a manner that an end portion thereof projects from at least one side surface of the substrate. The underfill material covers an external surface of the joint portion and covers the at least one side surface of the substrate in such a manner that the underfill material reaches the projecting end portion of the flow-path-forming member.

In another aspect of the present invention, there is also provided a process for producing the above-described liquid ejection head, including the step of, for forming a plurality of recording element substrates from a wafer, forming a space portion mutually partitioning substrate portions that constitute the plurality of recording element substrates in the wafer at a position corresponding to a dicing line when the wafer is diced and divided into the plurality of recording element substrates. In this step, the space portion is made larger than the thickness of a dicing blade.

Further features of the present invention will become apparent from the following description of exemplary embodiments with reference to the attached drawings.

DESCRIPTION OF THE EMBODIMENTS

Figure 1A:
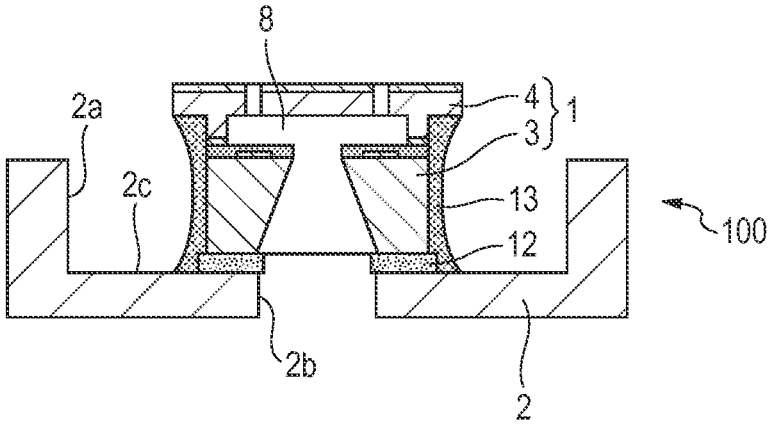
FIGS. 1A, 1B and 1C illustrate an ink jet recording head according to an embodiment of the present invention.

Preferred embodiments of the present invention will now be described in detail in accordance with the accompanying drawings.

It is known that a protecting film which is resistant to ink is formed on an inner side surface of an ink supply path passing through a recording element substrate at a stage of producing the recording element substrate.

However, since the recording element substrate is a diced chip cut out of a wafer by, for example, a dicing saw, silicon which is a substrate material is exposed at a side surface of the recording element substrate which is not covered with the sealing material according to the method described in Japanese Patent Application Laid-Open No. 2012-187804. When the exposed side surface of the recording element substrate comes into contact with an alkaline ink for a long period of time, there is a possibility that silicon may be dissolved. As a result, there is a concern of lowering of electric reliability with time.

In order to prevent such silicon from being dissolved, it is considered that a side surface (silicon surface) of the recording element substrate and a boundary portion between the back surface of the recording element substrate and the ink tank are sealed with what is called an underfill material to form such a construction that silicon comes into no contact with the ink.

However, when the expansion and contraction of the underfill material occur due to a temperature or humidity cycle, there may be a problem that the deformation or breakage of a portion whose rigidity is fragile is caused by stress produced by the contraction and expansion of the underfill material. In the case of a recording element substrate in which an ink supply path is formed to pass therethrough so that the rigidity tends to become relatively low, that problem becomes tangible in particular.

The underfill material is used according to a method in which the underfill material is applied to a place intended to seal, caused to penetrate into a space by a capillary phenomenon and cured by heating in the same manner as a liquid, heat-curable epoxy material generally used in IC packages of BGA (ball grid array) or CSP (chip size package). Even in an ink jet recording head, sealing is conducted with the same underfill material for the purpose of preventing ink leakage.

In addition, the underfill material includes UV-curable type or room-temperature humidity-curable type silicone resins in addition to the heat-curable type. Properties required of the underfill material include retention of sealing reliability against thermal stress and prevention of mechanical breakage by expansion and contraction.

Relaxation of sealing stress is similarly a problem to be solved even in an ink jet recording head. However, it has been difficult to avoid the influence of stress caused by a difference in coefficient of linear expansion between an object to be sealed and the underfill material with the conventional method.

The present invention has been made in view of the above problem and has as its object the provision of a construction in which a joint portion where an ink tank and a recording element substrate are joined to each other and a silicon material exposed to a side surface of the recording element substrate are sealed with an underfill material to inhibit ink leakage from the joint portion and dissolution of silicon. Another object is to provide a liquid ejection head having such a high reliability that deformation or breakage is hard to occur even when stress produced by contraction and expansion of the underfill material is applied to the sealed portion.

Embodiments of the present invention will now be described with reference to the accompanying drawings. The liquid ejection heads described below can be mounted in an apparatus such as a printer, a copying machine, a facsimile having a communicating system or a word processor having a printer section, and further in an industrial recording apparatus integrally combined with various processors.

By using such a liquid ejection head, recording can be performed on various recording media such as paper, thread, fiber, leather, metal, plastic, glass, wood and ceramic. In this embodiment, a liquid ejection head which employs an ink jet system as an ejection system and is used in such recording, i.e., an ink jet recording head, is taken as an example to describe the liquid ejection head. However, the present invention is not limited thereto.

Accordingly, the term "recording" used in the present specification means not only applying an image having a meaning such as a letter or a figure to a recording medium, but also applying an image having no meaning such as a pattern.

Further, the term "liquid" should be widely interpreted and means a liquid used in formation of, for example, an image, a design or a pattern, processing of a recording medium, or treatment of an ink or a recording medium, by applying it on to the recording medium.

The treatment of the ink or the recording medium means, for example, a treatment for improving the fixing ability of the ink by solidification or insolubilization of a coloring material in the ink applied to the recording medium, or improving recording quality, color developability or image durability.

Figure 1B:
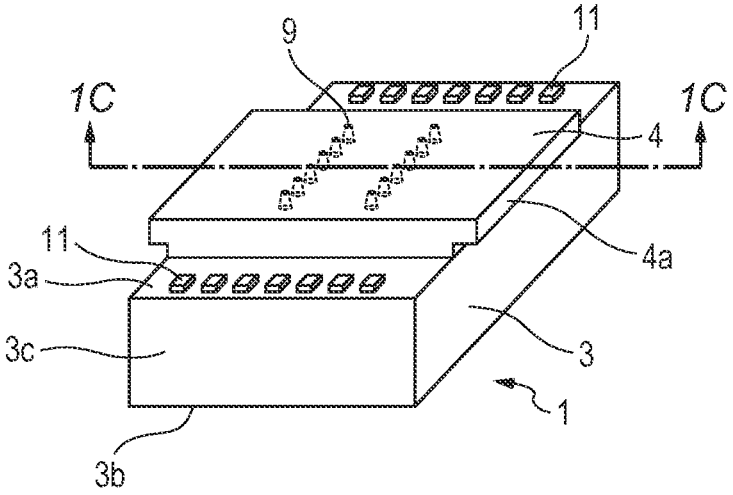
Figure 1C:
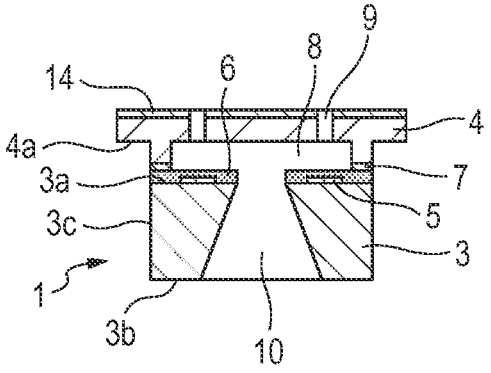

In the present invention, no limitation is imposed on a unit for generating energy for ejecting a liquid. However, a heating resistor which is an electrothermal converter is used in this embodiment. Constructional example of liquid ejection head:

FIGS. 1A, 1B and 1C illustrate an ink jet recording head according to this embodiment. FIG. 1A is a partial sectional view of the ink jet recording head in which a recording element substrate is joined to an ink tank, FIG. 1B is a perspective view illustrating the recording element substrate thereof, and FIG. 1C is a schematic sectional view taken along the line 1C-1C in FIG. 1B.

The ink jet recording head (liquid ejection head) 100 according to this embodiment is provided with a recording element substrate (element substrate) 1 and an ink tank (support member) 2 supporting the recording element substrate 1 as illustrated in FIG. 1A, but the support member may also be provided separately from the ink tank 2.

The recording element substrate 1 is provided with a silicon substrate 3 and a flow-path-forming member 4 joined to a front surface of the silicon substrate 3 as illustrated in FIGS. 1B and 1C.

The silicon substrate 3 has a structure in which a heating resistor 5 and a wiring are formed on a front side surface thereof. A protecting film 6 for protecting the heating resistor 5 and the wiring (not illustrated) from contact with ink is formed thereon. The flow-path-forming member 4 is joined to the front side surface of the silicon substrate 3 through an intermediate layer 7 for improving adhesion.

The flow-path-forming member 4 is provided with a flow path 8 containing a liquid chamber surrounding the heating resistor 5 and an ejection orifice 9 formed correspondingly to the heating resistor 5 for ejecting a liquid and communicating with the liquid chamber. An ink supply path 10 for supplying ink to the flow path 8 is formed in the silicon substrate 3. The ink supply path (liquid supply path) 10 passes from the front side surface of the silicon substrate 3 to the back surface thereof. A water-repellent film 14 is formed on an external side surface of the flow-path-forming member 4.

The silicon substrate 3 has a front surface 3*a* to which the flow-path-forming member 4 is joined, a back surface 3*b* located on the opposite side thereof and a plurality of (four in this embodiment) side surfaces 3*c*. Since the surrounding four side surfaces 3*c* are formed by etching a wafer as described in a production process which will be described subsequently, silicon is exposed to become a cur section rising almost perpendicularly to the back surface 3*c*.

With respect to peripheral edges of the front surface 3*a* of the silicon substrate 3, two peripheral edge portions respectively adjoining two opposing side surfaces 3*c* are exposed without being covered with the flow-path-forming member 4. A plurality of electrode pads 11 are arranged along the respective peripheral edge portions.

With respect to the ejection orifice 9 of the flow-path-forming member 4, a plurality of ejection orifices 9 are arranged in one direction to form an ejection orifice array, and plural ejection orifice arrays are provided in a direction intersecting the arranging direction of the ejection orifices 9. The arranging direction of the ejection orifices 9 corresponds to a direction intersecting a main scan direction of an ink jet recording head when a recording apparatus in which the ink jet recording head is mounted takes a serial type ink jet system.

The above-described recording element substrate 1 is joined to the ink tank 2 as illustrated in FIG. 1A. A depressed portion 2*a* in which the recording element substrate 1 is housed with the flow-path-forming member 4 facing to the outside is formed in the ink tank 2. A bottom surface of the depressed portion 2*a* has an ink supply port (liquid supply port) 2*b* communicating with an opening of the ink supply path 10 exposed to a back surface 3*b* of the silicon substrate 3 and a plane 2*c* which is present around the ink supply port 2*b* and is joined to the back surface 3*b* of the silicon substrate 3 with an adhesive 12. An ink within the ink tank 2 is supplied to the ink supply path 10 of the recording element substrate 1 through the ink supply port 2*b*.

In the case of this embodiment, the electrode pads 11 arranged at the peripheral edge portion of the front surface 3*a* of the silicon substrate 3 are electrically connected to a lead of an electric wiring board (not illustrated, for example, a TAB tape). In order to seal an electrical connection portion formed of such a lead and the electrode pads, a method in which a sealing material (thermosetting resin) is filled into a space between a side surface 3*c* of the silicon substrate 3 on the side on which the electrode pads 11 are arranged and a side wall of the depressed portion 2*a* of the ink tank 2 opposing this side surface to seal the electrical connection portion is taken. In this case, a joint portion where the side surface on the electrical connection side of the silicon substrate 3 and the back surface 3*b* of the silicon substrate 3 adjoining this side surface are joined to the ink tank 2 with an adhesive 12 can be covered with the sealing material.

On the other hand, a space between a side surface 3*c* of the silicon substrate 3 on the side on which no electrode pad 11 is arranged and a side wall of the depressed portion 2*a* of the ink tank 2 opposing this side surface is not filled with the sealing material. The reason for this is that the breakage of the recording element substrate by the temperature or humidity cycle as described in Description of the Related Art is prevented. In this space, a joint portion where the side surface of the silicon substrate 3 on the side where the electrical connection is not made and the back surface 3*b* of the silicon substrate 3 adjoining this side surface are joined to the ink tank 2 with the adhesive 12 is covered with an underfill material 13.

This can be realized by joining the recording element substrate 1 to the ink tank 2 with the adhesive 12 and then setting horizontal the side surface of the silicon substrate 3 on the side where the electrical connection is not made and supplying the underfill material 13 to this side surface in the production process of the ink jet recording head which will be described subsequently.

Above all, in the recording element substrate according to the present invention, the flow-path-forming member 4 widely projects from the silicon substrate 3 on the side of the silicon substrate 3 where the electrical connection is not made. Accordingly, when the side surface of the silicon substrate 3 on the side where the electrical connection is not made is set horizontal as described above and the underfill material 13 is applied to this side surface, the underfill material 13 spreads on this side surface to form a meniscus at a projecting end of the flow-path-forming member 4. In other words, the underfill material 13 covers the side surface of the silicon substrate 3 on the side where the electrical connection is not made so as to reach the projecting end of the flow-path-forming member 4.

The underfill material 13 covering the side surface of the silicon substrate 3 on the side where the electrical connection is not made and the adhesive 12 with which the back surface 3*b* of the silicon substrate 3 is joined to the ink tank 2 is cured while maintaining the form of the meniscus at the end of the flow-path-forming member 4 projected. As a result, when stress produced by expansion and contraction of the underfill material is applied to the projecting flow-path-forming member 4, the projecting portion 4*a* thereof is bent, whereby the stress can be absorbed.

In the embodiment illustrated in FIGS. 1A, 1B and 1C, an end surface of the flow-path-forming member 4 on the side of the silicon substrate 3 where the electrical connection is not made is aligned with the side surface of the silicon substrate 3 on the side where the electrical connection is not made up to a given height from the front surface 3*a* of the silicon substrate 3 and projects from this side surface above the given height. However, the present invention is not limited to this embodiment, and an embodiment illustrated in FIG. 2 may also be taken.

Figure 2:
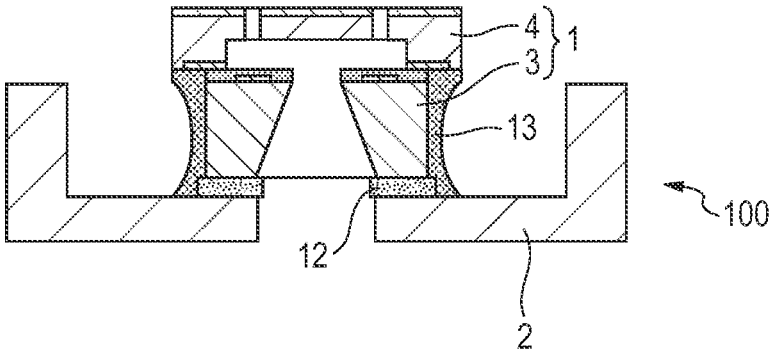
FIG. 2 illustrates a modified example of the ink jet recording head illustrated in FIGS. 1A, 1B and 1C.

In the embodiment illustrated in FIG. 2, the whole of the end surface of the flow-path-forming member 4 on the side of the silicon substrate 3 where the electrical connection is not made projects from the side surface of the silicon substrate 3 on the side where the electrical connection is not made.

Incidentally, in the above-described embodiment, the flow-path-forming member 4 is formed by processing an organic material having photosensitivity by a photolithographic method. However, the present invention is not limited thereto, and the same effect as in the case of the organic material can be achieved even when an inorganic material having ink resistance is used. In addition, the substrate to which the flow-path-forming member is joined for forming the recording element substrate 1 is the silicon substrate 3. However, the present invention is not limited thereto. The same effect as in the case of the silicon substrate 3 can be achieved even for an inorganic material which is liable to be dissolved in a liquid having a particular nature according to the method of the present invention.

The above-described embodiment illustrates the ink jet recording head of such a construction that the electrode pad 11 is provided on the front surface 3*a* of the silicon substrate 3, and the lead of the electric wiring board is electrically connected to the electrode pad 11 on the front surface 3*a*.

However, the liquid ejection head according to the present invention is not limited thereto. That is, the liquid ejection head may also have such a construction that the electrode pad is provided on another surface, for example, the back surface 3*b*, than the front surface 3*a* of the silicon substrate 3, and the electrode pad on the back surface 3*b* is joined to an electrical connection terminal (for example, a wiring pattern or a lead terminal) of the electric wiring board by, for example, soldering. In the case of this construction, the position of the electrical connection portion is located at the back surface of the silicon substrate 3, so that the side surface 3*c* of the silicon substrate 3 is not covered with the sealing material even when the electrical connection portion is sealed with the sealing material. Therefore, there is need to cover each side surface 3*c* of the silicon substrate 3 with the underfill material. Even in such a case, stress produced by the contraction and expansion of the underfill material can be absorbed by the projecting portion of the flow-path-forming member to inhibit the deformation or breakage of the recording element substrate so far as the method according to the present invention is applied.

Examples of Production Process of Liquid Ejection Head:

The production process of the ink jet recording head according to the embodiment illustrated in FIGS. 1A, 1B and 1C will now be described with reference to FIG. 3A to FIG. 7B.

Figure 3A:
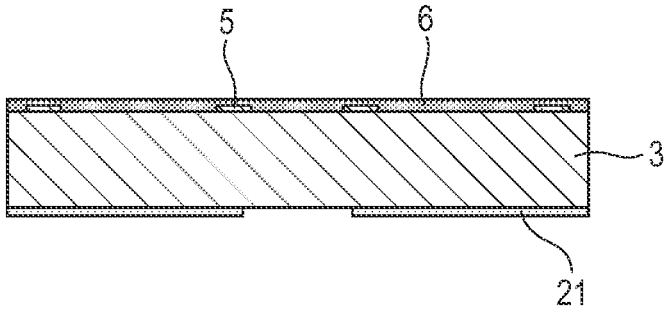
FIGS. 3A, 3B and 3C are sectional views illustrating a production process of an ink jet recording head according to an embodiment.

As illustrated in FIG. 3A, a heating resistor 5 is first formed on a front surface (principal surface) 3*a* of a silicon substrate (wafer) 3, and a protecting film 6 composed of SiN is formed thereon. A mask material 21 having an opening at a portion where an ink supply path 10 is formed is patterned on a back surface 3*b* of the silicon substrate 3.

Figure 3B:
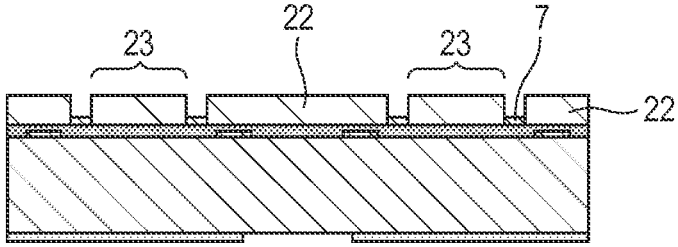

A photosensitive resist is then applied on to the side of the front surface of the silicon substrate 3. This resist is subjected to patterning by a photolithographic technique to leave a resist pattern in which an intermediate layer 7 for the purpose of the improvement of adhesion between a flow-path-forming member 4 and the silicon substrate 3, a mold material 22 for forming a flow path 8, and a mold material 23 located on a scribe line (a region to be cut by a dicing saw when the wafer is divided into plural recording element substrates, also referred to as a dicing line) are formed as illustrated in FIG. 3B.

At this time, the flow-path-forming member 4 according to the embodiment illustrated in FIG. 2 can be formed unless the mold material 23 is patterned on the scribe line of the silicon substrate (wafer) 3. That is, in the embodiment illustrated in FIGS. 1A, 1B and 1C, the mold material 23 of the same material as the mold material 22 is also formed at a position corresponding to the scribe line upon the patterning for forming the mold material 22, whereby a projecting portion 4*a* having a thickness thinner than the thickness of the flow-path-forming member 4 on the silicon substrate 3 is formed as illustrated in FIG. 1B or 1C. On the other hand, in the embodiment illustrated in FIG. 2, such a structure that the thickness of the projecting portion 4*a* is made thicker can be provided since the mold material 23 is not patterned at the position corresponding to the scribe line.

Figure 3C:
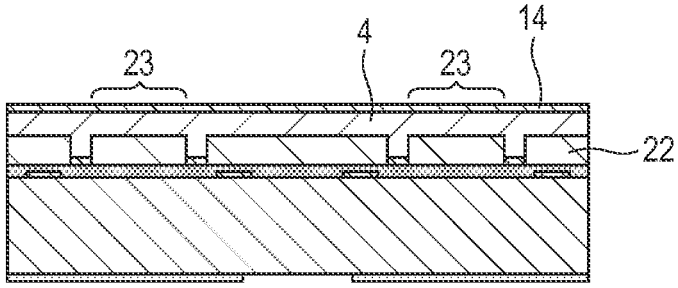

After a resin to be the flow-path-forming member 4 having negative photosensitivity is then applied in a desired thickness thicker than the mold materials 22 and 23 as illustrated in FIG. 3C, a water repellent material is applied on to the whole upper surface of the resin to be the flow-path-forming member 4 to form a water repellent film 14 on the flow-path-forming member 4.

Figure 4A:
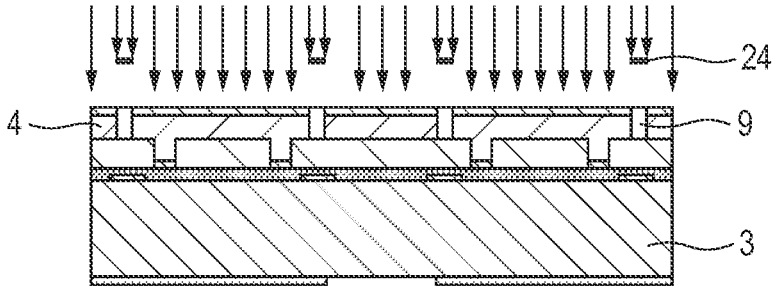
FIGS. 4A, 4B and 4C are sectional views illustrating a production process of an ink jet recording head according to an embodiment.

As illustrated in FIG. 4A, a mask 24 which prevents a portion where an ejection orifice 9 of the flow-path-forming member 4 is formed from being exposed is used to apply an energy of 2,000 J/m$^2$ to 8,000 J/m$^2$ to the flow-path-forming member 4 through the mask 24. Thereafter, the exposed product is immersed in a prescribed developing solution to remove the unexposed portion of the flow-path-forming member 4 so as to form the ejection orifice 9 at that portion.

In general, plural regions of the recording element substrate 1 are formed by partitioning a wafer by scribe lines, and the wafer is cut along the scribe lines by, for example, a dicing saw, whereby plural recording element substrates 1 are obtained from the wafer. Therefore, a portion of the flow-path-forming member 4 located on the scribe line is removed by the dicing, and a section of the silicon substrate 3 and a section of the flow-path-forming member 4 after cut along the scribe line are aligned with each other without producing a level difference.

On the other hand, in this embodiment, the respective recording element substrates 1 require to take such a construction that an end portion of the flow-path-forming member 4 corresponding to a side surface of the silicon substrate 3 projects from that side surface. Therefore, it is necessary to leave the portion of the flow-path-forming member 4 located on the scribe line. The above-described patterning of the mold materials 22 and 23 is conducted so as to realize such construction.

Figure 4B:
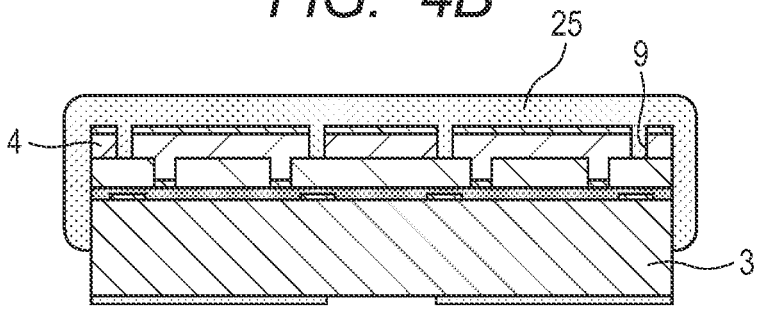

As illustrated in FIG. 4B, a mask material 25 protecting the flow-path-forming member 4 is then applied along the flow-path-forming member 4 so as to be filled also into the ejection orifice 9 prior to formation of an ink supply path 10 in the silicon substrate 3.

Figure 4C:
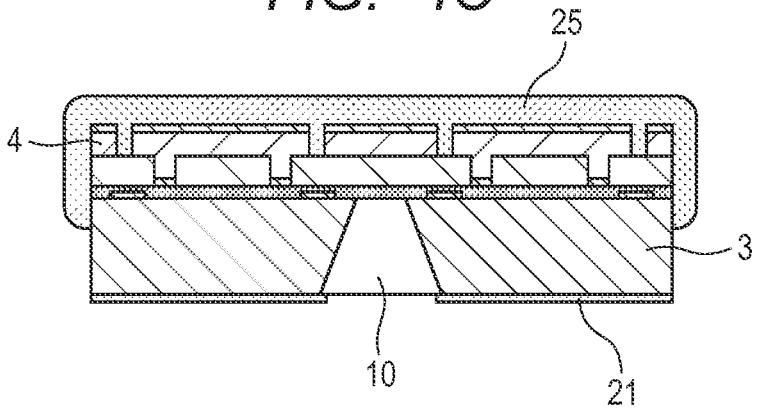

The resulting product in which the flow-path-forming member 4 is protected by the mask material 25 as described above is immersed for a predetermined period of time in an etchant which dissolves silicon. The silicon of the silicon substrate 3 is subjected to anisotropic wet etching through the opening of the mask material 21 patterned on the back surface 3*b* of the silicon substrate 3, thereby forming an ink supply path 10 passing through between the back surface of the silicon substrate 3 and the front surface thereof as illustrated in FIG. 4C.

Figure 5A:
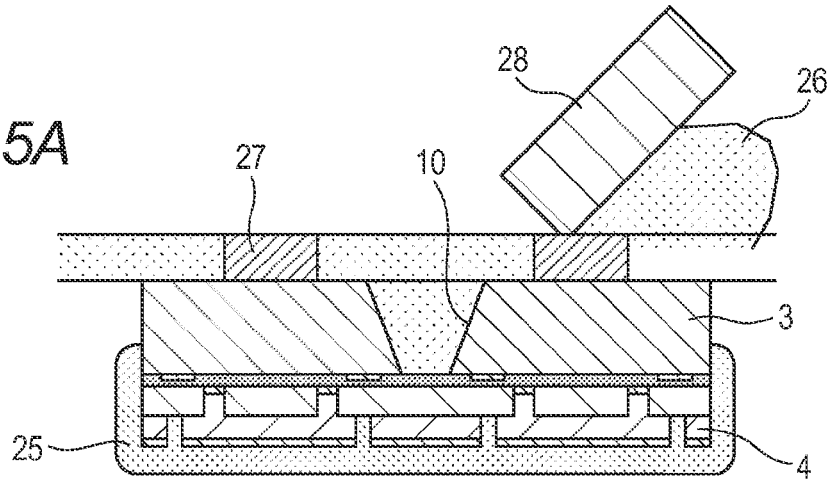
FIGS. 5A, 5B, 5C and 5D are sectional views illustrating a production process of an ink jet recording head according to an embodiment.

A mask material 26 for dry etching is then applied on to the back surface of the silicon substrate 3 for etching the silicon of a desired region by a dry etching method from the side of the back surface of the silicon substrate 3. To do this, as illustrated in FIG. 5A, a printing plate 27 is arranged on the back surface of the silicon substrate 3, the mask material 26 is supplied on to the printing plate 27, printing is conducted by means of, for example, a screen printing technique in such a manner that the mask material 26 is pressed into an opening of the printing plate 27 by a printing blade 28, and the mask material 26 is then heat-cured. At this time, the mask material 26 is filled into the opening of the ink supply path 10 of each recording element substrate 1, and at the same time the mask material 26 is printed over a range which is to be the back surface of the silicon substrate 3 of each recording element substrate 1.

Figure 5B:
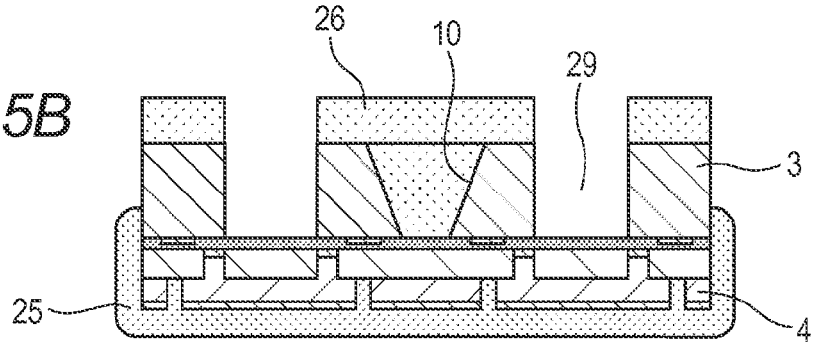

An etching gas containing $SF_6$ or $C_4F_8$ is then supplied by means of a dry etching method to remove the silicon of the silicon substrate 3 corresponding to the opening of the mask material 26, thereby forming a silicon-removed portion 29 in the silicon substrate 3 as illustrated in FIG. 5B. The silicon-removed portion 29 becomes a blank portion partitioning portions of the silicon substrate 3 constituting the respective recording element substrates 1. The silicon-removed portion 29 is larger than the thickness of a dicing blade 31 (see FIG. 6A).

Incidentally, the ink supply path 10 formed in FIG. 3C may also be formed in this dry etching step.

Figure 5C:
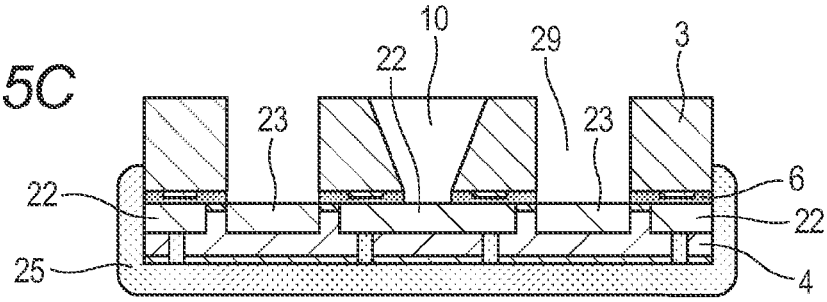

Thereafter, the mask material 26 is removed with a dedicated solution as illustrated in FIG. 5C. In addition, a part of the protecting film 6 composed of SiN is removed through the ink supply path 10 and the opening of the silicon-removed portion 29 formed in the back surface of the silicon substrate 3 by means of the dry etching method.

Figure 5D:
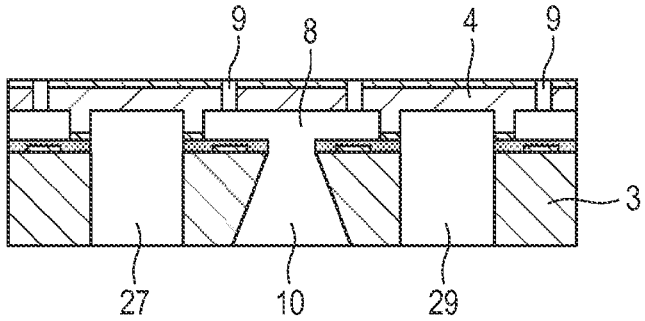

The resulting product obtained in this treatment is immersed for a fixed period of time in a dedicated remover to remove the mask material 25 and the mold materials 22 and 23 which have been used for protecting the flow-path-forming member 4 as illustrated in FIG. 5D. As a result, the ink supply path 10 and the flow path 8 communicate with the ejection orifice 9. In addition, a portion corresponding to the silicon-removed portion 29 of the flow-path-forming member 4 remains without being removed.

In addition, the resulting product in which the mask material 25 and the mold materials 22 and 23 have been removed in this manner is baked for about 60 minutes in an environment of about 200° C., thereby curing the flow-path-forming member 4.

Figure 6A:
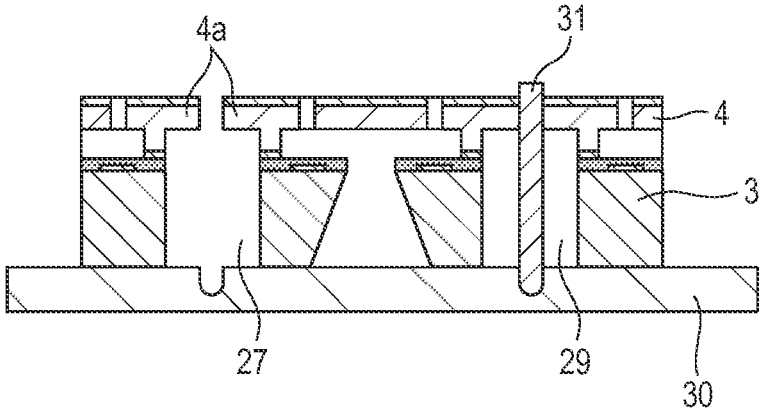
FIGS. 6A, 6B and 6C are sectional views illustrating a production process of an ink jet recording head according to an embodiment.

After the silicon substrate 3 is then stuck on a dicing tape 30 as illustrated in FIG. 6A, the flow-path-forming member 4 is cut out by means of a dicing blade 31 rotating at a high speed to form a projecting portion 4*a* of the flow-path-forming member 4. When the flow-path-forming member 4 is cut out, the dicing blade 31 is put into the center of the silicon-removed portion formed by removing the mold material 23 located on the scribe line.

Upon this cutting, the projection amount of the projecting portion 4*a* can be made larger as the thickness (width) of the dicing blade 31 is made thinner and can be made smaller as the thickness is made thicker.

When the covering amount of the underfill material 13 is intended to be changed at, for example, left and right side surfaces of the recording element substrate 1 of the ink jet recording head, the accumulable amount of the underfill material can be thereby adjusted by changing the thickness of the dicing blade 31 at the left and right of the silicon substrate portions making up the respective recording element substrates 1.

Alternatively, the projection amount of the projecting portion 4*a* relating to the accumulable amount of the underfill material may also be adjusted by changing the size (the width partitioning portions of the silicon substrate constituting the respective recording element substrates 1) of the silicon-removed portion 29 without changing the thickness of the dicing blade 31.

Figure 6B:
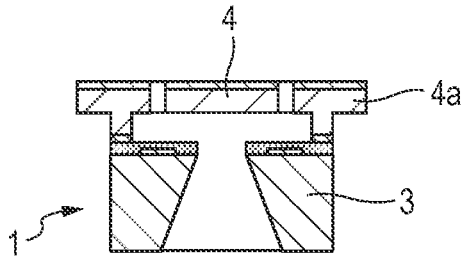

When the flow-path-forming member 4 is cut out in the above-described manner, plural recording element substrates 1 illustrated in FIG. 6B are obtained. Each recording element substrate 1 has such a construction that an end portion of the flow-path-forming member 4 corresponding to a side surface of the silicon substrate 3 projects from that side surface.

Figure 6C:
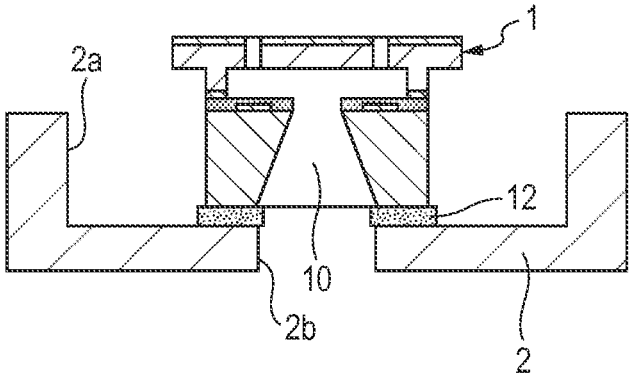

As illustrated in FIG. 6C, the recording element substrate 1 is then joined to a bottom surface of a depressed portion 2*a* of an ink tank 2 with an adhesive 12. At this time, an ink supply port 2*b* of the ink tank 2 communicates with the ink supply path of the recording element substrate 1.

Figure 7A:
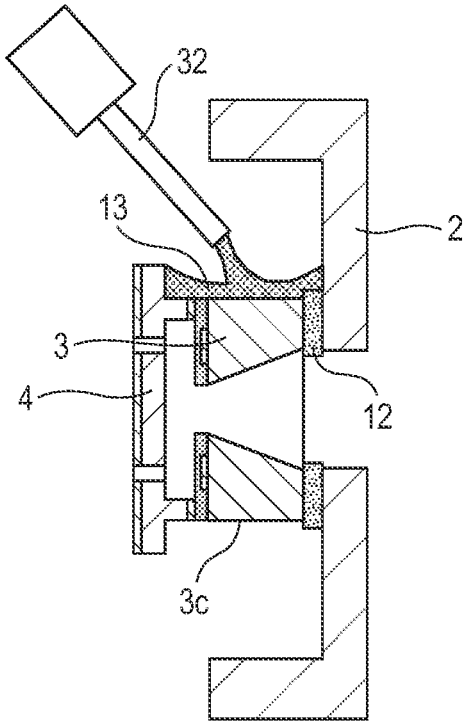
FIGS. 7A and 7B are sectional views illustrating a production process of an ink jet recording head according to an embodiment.

As illustrated in FIG. 7A, the position of the ink tank 2 which is a support member supporting the recording element substrate 1 is then changed, whereby a side surface 3*c* to be protected of the silicon substrate 3 in the recording element substrate 1 (a side surface of the silicon substrate 3 on the side where the electrical connection is not made in this embodiment) is made horizontal. The underfill material 13 is supplied to this side surface by a needle 32 by means of a dispense coating technique. The underfill material 13 supplied covers the side surface of the silicon substrate 3 to be protected and an external surface of the adhesive 12 where the back surface of the silicon substrate 3 adjoining at side surface is joined to the ink tank 2.

At this time, the underfill material 13 spreads on that side surface and is supplied so as to form a meniscus at an end of the flow-path-forming member 4 projecting from the silicon substrate 3. That is, the side surface of the silicon substrate 3 to be protected from ink is covered with the underfill material 13 in such a manner that the underfill material 13 reaches the end of the projecting portion 4*a* of the flow-path-forming member 4.

Thereafter, a heat-curing step is performed, whereby the underfill material 13 covering the side surface of the silicon substrate 3 on the side where the electrical connection is not made and the external surface of the adhesive 12 where the back surface 3*b* of the silicon substrate 3 is joined to the ink tank 2 is cured while maintaining the form of the meniscus at the projecting end of the flow-path-forming member 4.

Figure 7B:
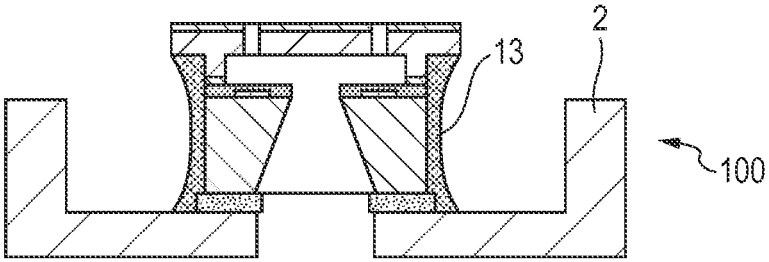

When the application and curing of the underfill material 13 are performed for all the side surfaces of the silicon substrate 3 to be protected, an ink jet recording head 100 illustrated in FIG. 7B is completed.

In the embodiment described above, the flow-path-forming member is formed on the substrate in such a manner that the end portion of the flow-path-forming member projects from the side surface of the substrate to be protected. The underfill material covering the side surface of the substrate to be protected and the external surface of the adhesive where the substrate is joined to the support member supporting this substrate is cured while maintaining the form of the meniscus at the projecting end of the flow-path-forming member 4.

The underfill material arranged in this manner expands and contracts attributing to a temperature or humidity cycle, and stress of such expansion and contraction is applied to the projecting portion of the flow-path-forming member, and so that projecting portion can be bent to absorb that stress. Accordingly, a liquid ejection head having such a high long-term reliability that deformation or breakage of the recording element substrate in which the ink supply path is formed is inhibited can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-220307, filed Oct. 23, 2013, which is hereby incorporated by reference herein in its entirety.

What is claimed is:

1. A liquid ejection head comprising:

a recording element substrate provided with a substrate and a flow-path-forming member forming a flow path in a principal surface of the substrate;

a support member supporting the recording element substrate; and an underfill material covering at least a joint portion at which the substrate and the support member are joined to each other, wherein the recording element substrate is arranged in a depressed portion of the support member to form a space between a side surface of the recording element substrate and a side wall of the support member forming the depressed portion opposing the side surface, wherein the underfill material does not completely fill the space between a side surface of the recording element substrate and a side wall of the support member forming the depressed portion opposing the side surface, wherein the flow-path-forming member has an end portion which projects from at least one side surface of the substrate, and wherein the underfill material covers an external surface of the joint portion and covers the at least one side surface of the substrate in such a manner that the underfill material reaches the projecting end portion of the flow-path-forming member.

2. The liquid ejection head according to claim 1, wherein the projecting end portion of the flow-path-forming member deforms to absorb stress produced by expansion and contraction of the underfill material.

3. The liquid ejection head according to claim 1, wherein the underfill material with which the side surface is covered is formed as a meniscus at an end of the flow-path-forming member projecting from the side surface.

4. The liquid ejection head according to claim 1, wherein the side surface is a surface of silicon.

5. The liquid ejection head according to claim 1, wherein the recording element substrate has an electrical connection portion for electrically connecting an electric wiring board to a surface on the side where the flow-path-forming member is formed, a side surface of the recording element substrate on the side where electrical connection is made is covered with a sealing material sealing the electrical connection portion, and a side surface of the recording element substrate on the side where electrical connection is not made is the at least one side surface of the substrate covered with the underfill material.

6. The liquid ejection head according to claim 1, wherein a surface of the substrate on the side opposite to the principal surface of the substrate is joined to the support member, the support member has a liquid supply port for supplying a liquid to the recording element substrate, and the recording element substrate is provided with a liquid supply path for supplying the liquid from the liquid supply port to the flow path.

7. The liquid ejection head according to claim 1, wherein the underfill material is not in contact with the side wall of the support member forming the depressed portion opposing the side surface of the recording element substrate.

8. A process for producing a liquid ejection head comprising a recording element substrate provided with a substrate and a flow-path-forming member forming a flow path in a principal surface of the substrate and a support member supporting the recording element substrate, wherein the flow-path-forming member is formed in such a manner that an end portion thereof projects from at least one side surface of the substrate, an external surface of a joint portion where the substrate and the support member are joined to each other is covered with an underfill material, and the at least one side surface of the substrate is covered with the underfill material in such a manner that the underfill material reaches the projecting end portion of the flow-path-forming member, the process comprising:

the step of arranging the recording element substrate in a depressed portion of the support member;

the step of applying the underfill material to a side surface of the recording element substrate so as not to completely fill a space between the side surface of the recording element substrate and a side wall of the support member forming the depressed portion opposing the side surface; and the step of, for forming a plurality of recording element substrates from a wafer, forming a space portion mutually partitioning substrate portions that constitute the plurality of recording element substrates in the wafer at a position corresponding to a dicing line when the wafer is diced and divided into the plurality of recording element substrates, wherein the space portion is made larger than the thickness of a dicing blade.

9. The process according to claim 8, wherein the wafer and the flow-path-forming member are diced at a position of the space portion to divide the wafer into the plurality of recording element substrates, whereby the flow-path-forming member is formed in such a manner that an end portion thereof projects from the at least one side surface of the substrate.

10. The process according to claim 9, wherein, when the external surface of the joint portion is covered with the underfill material and the at least one side surface of the substrate is covered with the underfill material in such a manner that the underfill material reaches the projecting end portion of the flow-path-forming member, the underfill material is supplied so as to form a meniscus at the projecting end portion.

11. The process according to claim 8, wherein the underfill material is applied so as not to be in contact with the side wall of the support member forming the depressed portion opposing the side surface of the recording element substrate.

* * * * *